United States Patent [19]

Lorenzana et al.

[11] Patent Number: 5,009,028

[45] Date of Patent: Apr. 23, 1991

[54] APPARATUS FOR SUPPLYING WATER CONTINUOUSLY TO TREE STAND

[76] Inventors: Moises B. Lorenzana, 601 Lake Hinsdale Dr., Willowbrook, Ill. 60559; Vance A. Lorenzana, 698 Spring Hill Cir., Naperville, Ill. 60540

[21] Appl. No.: 109,860

[22] Filed: Oct. 19, 1987

[51] Int. Cl.[5] ..... A47G 33/12; B67D 5/06; A01K 7/00

[52] U.S. Cl. ..... 47/40.5; 47/57.5; 47/79; 222/185; 119/77

[58] Field of Search ..... 47/40.5, 79, 48.5, 57.5; 119/51.5, 77; 222/185

[56] References Cited

U.S. PATENT DOCUMENTS

| | | | |
|---|---|---|---|
| 1,009,437 | 11/1911 | Patnaude | 222/185 |
| 4,653,224 | 3/1987 | Weckesser | 47/79 |

FOREIGN PATENT DOCUMENTS

| | | | |
|---|---|---|---|
| 1470464 | 2/1967 | France | 47/80 |
| 197709 | 9/1977 | U.S.S.R. . | |
| 573716 | 9/1977 | U.S.S.R. | 222/185 |

*Primary Examiner*—Danton D. DeMille
*Attorney, Agent, or Firm*—Neil M. Rose

[57] ABSTRACT

Apparatus for supplying water to a Christmas tree stand continuously from a large reservoir including a supporting stand to maintain a constant level supply of water and a delivery tube to provide a siphon action to supply water to the tree stand.

1 Claim, 2 Drawing Sheets

APPARATUS FOR SUPPLYING WATER CONTINUOUSLY TO TREE STAND

BACKGROUND OF THE INVENTION

This invention relates broadly to apparatus for supplying water to a supporting stand of the type used for cut Christmas trees and more specifically to method and apparatus for maintaining a constant water level in such a tree stand by providing a continuous flow from a constant level remote reservoir.

It is common practice in the United States to display within the home during the Christmas Season decorated evergreen trees which have been cut and sold specifically for such display which normally lasts only a few weeks. In order to keep the tree as well preserved as possible and to prevent it from drying out and losing its needles, it is common to employ a stand which includes a water receptacle in which the bottom or cut end of the tree's trunk is immersed. By keeping the bottom end of the trunk so immersed in water, the owner reduces the possible fire hazard which a dried out tree would present.

One of the problems with such tree stands is the fact that it is difficult to observe the water level in the tree stand receptacle and it is also difficult to fill the receptacle when the water evaporates therefrom or is absorbed by the tree supported therein.

The recently issued U.S. Pat. No. 4,653,224 to Weckesser is illustrative of one approach to solving these problems. The Weckesser patent is directed to a Christmas tree irrigation device that supplies water from a separate receptacle through a flexible tube to the water container in a tree stand. The device of the Weckesser patent includes no means to continuously supply water to the tree stand and requires that the user observe the water level in the tree stand to determine when additional water is needed and how much water is needed. It would be preferable to have an irrigation or watering device which would automatically supply water on a continuous basis to the tree stand to maintain a predetermined, constant level of water therein.

BRIEF SUMMARY OF THE INVENTION

Our invention is directed to apparatus for supplying water continuously to a tree stand of the type having a water receptacle in which the bottom end of a supported tree is received. A reservoir including means for supporting an upended bottle in an upwardly facing recess with the mouth of said bottle being positioned above a horizontal support surface a distance equal to the level at which water is to be maintained in said tree stand and a flexible tube connecting the bottom of said recess to said tree stand so that a siphon action may maintain the water level in said tree stand.

Accordingly, it is an object of the present invention to provide an improved apparatus and method for supplying water continuously to a tree stand.

It is another object of the present invention to provide an improved tree watering method and apparatus in which a remote watering device including a reservoir supplies water continuously to the water containing portion of a tree stand through a siphon action.

It is a further object of the present invention to provide an improved tree watering method and apparatus including a remote reservoir having substantial water capacity for delivering water to a constant level device which is connected by a flexible tube to the water containing receptacle in a tree stand.

While the present invention is described in particularity in the claims annexed to and forming a part of this invention, a better understanding of the invention can be had by reference to the following description taken in conjunction with the accompanying drawings in which:

Figure 1:
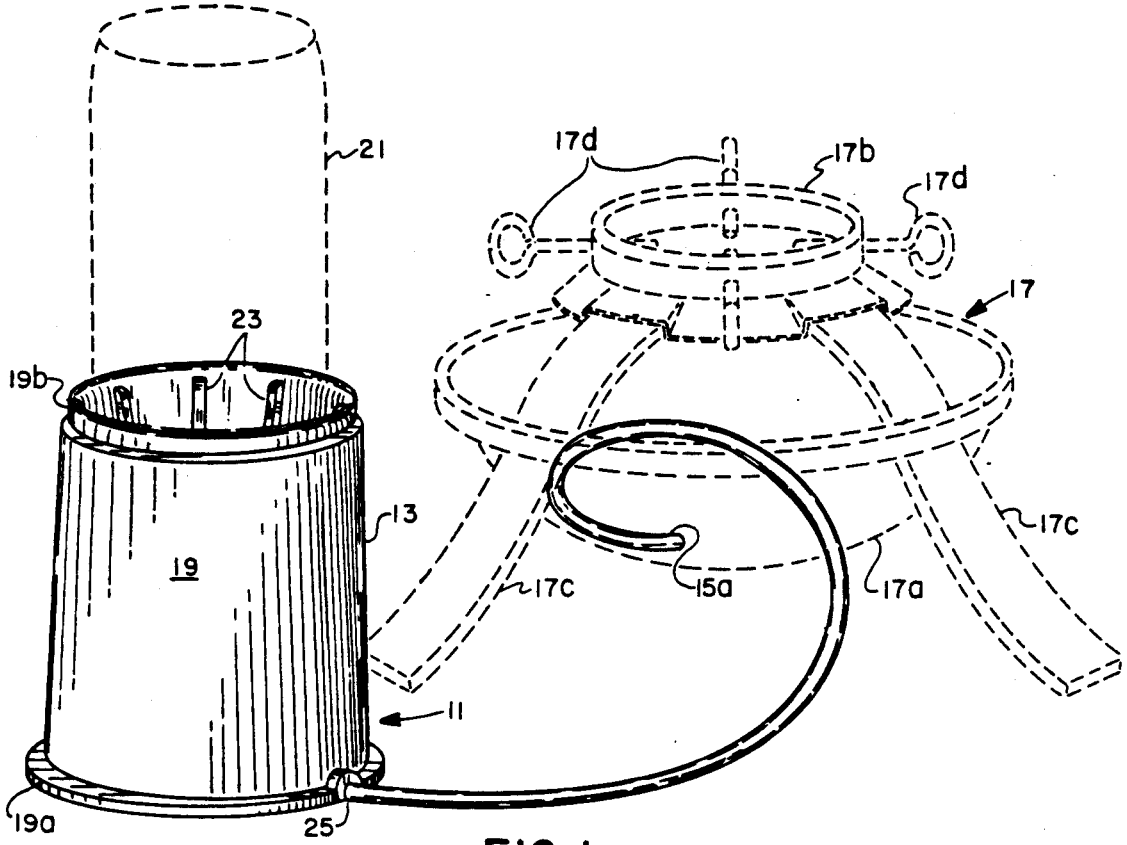
FIG. 1 is a perspective view of a preferred embodiment of our watering apparatus for a tree stand embodying our invention with a tree stand and water bottle with which it would be used shown in dashed lines.

Referring to the drawings, there is shown our apparatus for supplying water continuously to a tree stand which apparatus is designated generally by reference numeral 11. The apparatus 11 includes a reservoir 13 and a water delivery tube 15 which may be made of flexible rubber or vinyl tubing. The apparatus 11 is designed to supply a relatively large volume of water continuously over a period of time to a tree supporting stand shown in dashed lines and designated by reference numeral 17.

The tree stand 17 is of a type widely available for supporting Christmas trees during the Holiday Season and typically includes a receptacle 17*a* and a tree retaining ring 17*b* which are supported by legs 17*c*. A Christmas tree is placed in the stand 17 with the cut end of the trunk extending to the bottom of the receptacle 17*a* and the trunk is held in an upright vertical position by engagement with four threaded bolts 17*d* which may be advanced radially with respect to the ring 17*b* as a consequence of the bolts 17*d* being threadedly engaged with ring 17*b*. The receptacle 17*a* is typically filled with water so that the cut lower end of the tree trunk is immersed in water to retard the drying out of the tree. The bottom of the receptacle 17*a* is conventionally less than an inch above the surface on which the tree stand 17 is supported and the depth of the water in the receptacle 17*a* need only be a few inches deep to cover the cut end of the trunk.

Referring now to the reservoir 13, we note that it includes a support base or housing 19 which comprises a truncated conical wall terminating at the bottom in a flange 19*a* and at the top in a shouldered edge 19*b*. Integrally molded with the support base 19 is a bottle support 20 which includes a hemispherical portion 20*a* interconnected with a generally cylindrical portion 20*b*. The cylindrical portion 20*b* is slightly tapered and terminates in a bottom 20*c*.

Figure 3:
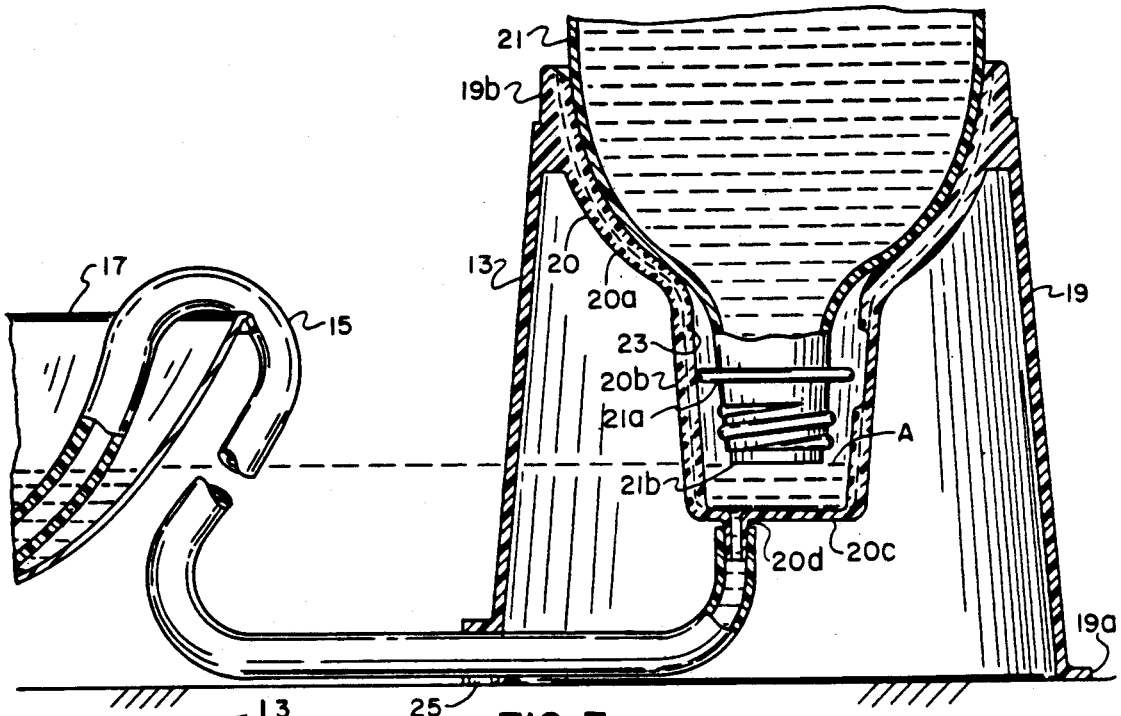
FIG. 3 is an enlarged vertical sectional view taken on line 3—3 of FIG. 4 including a portion of the water bottle and the tree stand and the water delivery tube.
Figure 4:
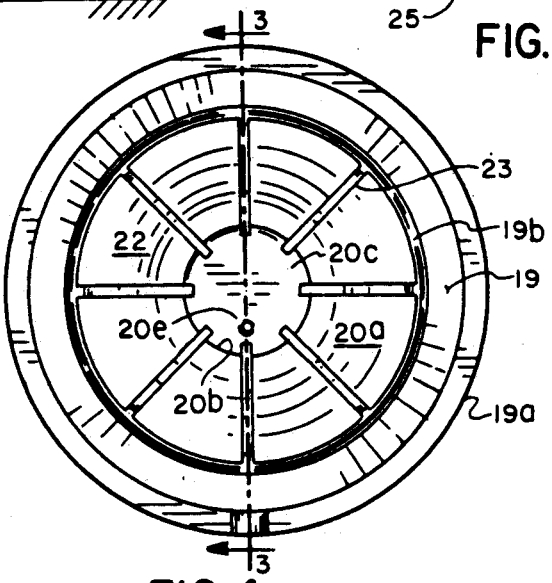
FIG. 4 is a top plan view of the apparatus of FIGS. 1 and 2 with the water delivery tube removed.
Figure 5:
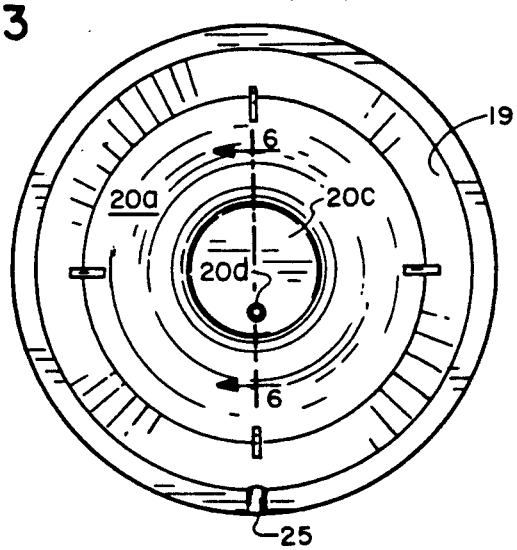
FIG. 5 is a bottom plan view of the apparatus of FIG. 3.
Figure 6:
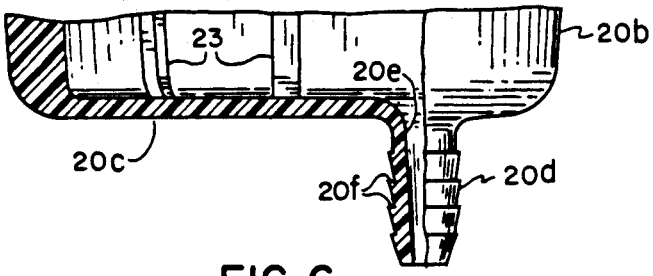
FIG. 6 is an enlarged fragmentary sectional view of a portion of the apparatus taken substantially along line 6—6 of FIG. 5.

As is best shown in FIGS. 3 and 6, the bottom 20*c* is formed with a nipple 20*d* through which a passageway 20*e* extends. The nipple 20*d* is provided with a series of axially spaced annular ridges 20*f* which frictionally engage the interior of the tubing 15 to retain it in position assembled to the nipple 20*d*.

The bottle support 20 is shaped and dimensioned to receive and support in an upended position a bottle 21 which would preferably be a two liter plastic bottle of the type in which carbonated soft drinks are sold. The walls of the bottle support 20 are formed with ribs 23 which extend from close to the top of the cup shaped recess formed by support 20 to the bottom 20*c*. The bottle 21 is typically formed with a flange 21*a* spaced less than an inch from mouth 21*b* of the bottle as shown in FIG. 3. The flange 21*a* of the bottle 21 engages the eight ribs 23 as best illustrated by FIG. 3 in which two of the ribs 23 are shown in section with a portion of the right rib cut away to show the location of the wall of recess 20*b* between the ribs 23. The neck flange 21*a* stabilizes the bottle 21 within the support 20 with the mouth 21*b* spaced above the bottom wall 20*c*. The bottle support 20 forms an upwardly facing recess 22 which accommodates the bottle 21 and the constant level water supply for the tree stand 17 as will be explained below.

Figure 2:
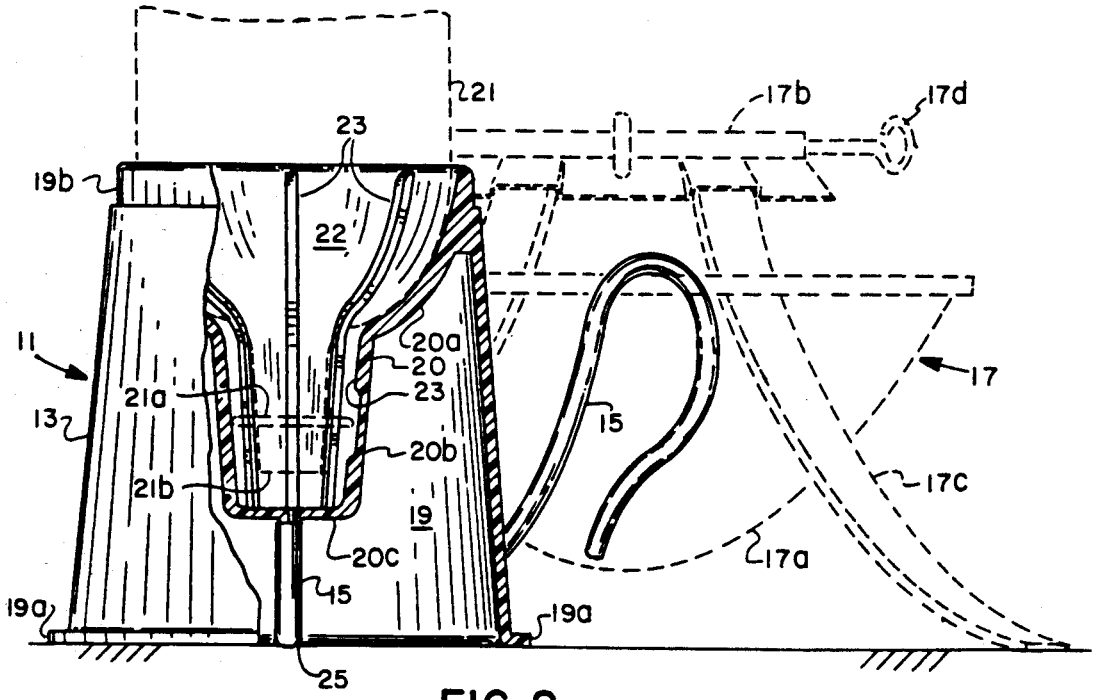
FIG. 2 is a side elevational view of the apparatus of FIG. 1 with a portion of the housing cut away to expose portions of the reservoir and recess which supports the bottle.

When the bottle 21 is filled with water and placed in the bottle support 20 with the mouth 21*b* downwardly as shown in FIG. 2, the water will begin to discharge from the bottle 21 into the recess 22 formed by the bottle support 20. This discharge of water will continue only as air is permitted to enter the mouth of the bottle 21. With the bottle resting as shown in FIG. 2, the surface of the water "A" in the cylindrical portion 20*b* will be substantially level with the mouth 21*b* of the bottle. As water is drained from the cylindrical portion 20*b*, it will reach a level below the mouth 21*b* whereupon air may enter the bottle 21 allowing water to discharge from the bottle 21 into the recess 20*b*. This action results in the level of the water within the reservoir 13 being substantially constant.

The ribs 23 on the walls of the bottle support 20 space the bottle 21 from the walls 20*a* and 20*b*, assuring the free passage of air to the mouth 21*b* of the bottle when the water level is such as to permit air to enter the mouth of the bottle. The ribs 23 provide a firm support for the bottle 21 but have limited surface engagement so that the bottle may be easily removed from reservoir 13 for refilling when necessary.

To permit the tube 15 to extend from its connection with the nipple 20*d* to the tree stand 17, the lower edge of the base 19, including the flange 19*a*, is formed with an opening or notch 25 in which the tube 15 is received. The tube 15 is on the order of six feet long, providing sufficient length for the reservoir 13 to be placed out from under the limbs of the tree supported in the stand 17 and for the tubing to have a loop 15*a* which would encircle the bottom of the tree trunk supported in the stand 17. By merely looping the tubing 15 around the trunk in the stand, the need for any secondary assembly or attachment means to secure the tube 15 to the stand 17 is eliminated.

The method involved in using the apparatus 11 is simple and involves only a few steps. The feed tube 15 is first inserted into the receptacle 17*a* of the tree stand with the end of the tube laid around the tree trunk to assure that it will not be displaced therefrom. The bottle 21 is then filled with water and placed in the recess 22 in the reservoir 13 with the mouth 21*b* of the bottle downward. A small amount of water then discharges from the bottle 21, filling the lower portion of recess 22 up to the mouth of the bottle 21*b*.

In order to start the siphon action to assure continuous water flow between the reservoir 13 and the stand receptacle, it is necessary to raise the reservoir 13 until the level of water in recess 22 is above the top edge of the tree stand receptacle 17*a*. At that time, water will begin to flow through the tube 15 and the reservoir 13 is then placed down on the floor or surface on which the stand 17 is also supported. The flow of water through the tube 15 will continue until the surface of water in the receptacle 17*a* is level with the water surface "A" in the reservoir recess 22. When the level equalizes, the flow through the tube 15 will cease. However, when the water level in the receptacle 17*a* drops as a consequence of evaporation or absorption by the tree supported by the stand, the flow of water in tube 15 will resume to again equalize the water levels. In one constructed embodiment of our invention, the tube 15 was made of a widely available vinyl tubing having an internal diameter of 0.125 inches.

Since the level of the water in the recess 22 of the reservoir 13 will be at the same height as the water delivered by the tube 15 to the tree stand, the reservoir 13 is dimensioned so that the mouth of the bottle 21 and, therefore, the level of the water in recess 22 will be about two and one half inches above the supporting surface. This water level is sufficient to adequately cover the bottom cut end of a tree in a standard tree stand and not so high as to flow over the top of the water receptacle of any of the tree stands which have been seen on the market. In the event that the two and one-half inch water level was not high enough for some tree stand, any sort of flat member could be inserted beneath the reservoir 13 to elevate the water level in the recess 22 to a height above the bottom of the tree stand receptacle sufficiently to cover the cut end of the trunk.

Once the apparatus has been installed with the bottle 21 filled with water, it will provide a continuous supply of water to the tree stand until the water in the bottle has been exhausted. The user may easily and simply check the water level in the bottle and need not crawl under the tree to check the tree stand receptacle to get the assurance that the tree will continue to be supplied with water. The use of the standard plastic bottle 21 as a container for the reservoir 13 avoids the necessity of including an additional bulky part with the product as sold.

The apparatus 11 provides a simple, inexpensive means of maintaining water in a Christmas tree stand with a minimum amount of attention by the user. The long delivery tube 15 permits the reservoir 13 to be situated in an inconspicuous, out-of-sight location where it will not detract visually from the decorated Christmas tree.

What is claimed as new and desired to be secured by Letters Patent of the United States is:

1. A continuous watering apparatus for use with a tree stand which mounts a cut tree vertically with the severed trunk end immersed in water to prevent the tree from drying out comprising a reservoir having a base for supporting said reservoir on a horizontal surface adjacent said tree stand, said reservoir having walls defining an upwardly facing recess, means in said recess engaging and supporting in an upended position a water bottle, said bottle having a mouth which in said upended position is spaced above the bottom of said recess, an elongated flexible water supply tube connected to said reservoir at the bottom of said recess, said reservoir supporting the mouth of said bottle at a height equal to the desired water level in said tree stand whereby through a siphon action said reservoir will supply water continuously to said tree stand until the water is drained from said bottle, said recess having an upper portion of generally hemispherical shape and a lower portion which is generally cylindrical, terminating in said bottom of said recess, said upper and lower portions being sized to detachably receive said bottle, said bottle having a neck extending into said lower portion with the mouth of said bottle spaced above said bottom, a plurality of projections on said walls of said recess to space said bottle from said walls to permit air to enter said bottle as the water level drops below said bottle mouth in said lower portion of said recess, said projections comprise peripherally spaced ribs which extend from the top of said recess to the bottom.

* * * * *